US010695940B2

(12) United States Patent
Imai

(10) Patent No.: US 10,695,940 B2
(45) Date of Patent: Jun. 30, 2020

(54) CORRUGATED BOARD MANUFACTURING SYSTEM AND CORRUGATED BOARD MANUFACTURING METHOD

(71) Applicant: IMAI INDUSTRY CO., LTD., Hirakawa-shi, Aomori (JP)

(72) Inventor: Masafumi Imai, Hirakawa (JP)

(73) Assignee: IMAI INDUSTRY CO., LTD., Hirakawa-shi, Aomori (JP)

( * ) Notice: Subject to any disclaimer, the term of this patent is extended or adjusted under 35 U.S.C. 154(b) by 0 days.

(21) Appl. No.: 16/078,426

(22) PCT Filed: Feb. 28, 2017

(86) PCT No.: PCT/JP2017/007669

§ 371 (c)(1),
(2) Date: Aug. 21, 2018

(87) PCT Pub. No.: WO2017/150498

PCT Pub. Date: Sep. 8, 2017

(65) Prior Publication Data

US 2019/0039259 A1 Feb. 7, 2019

(30) Foreign Application Priority Data

Feb. 29, 2016 (JP) ..... 2016-036803

(51) Int. Cl.
*B27D 1/08* (2006.01)
*B27D 3/00* (2006.01)
(Continued)

(52) U.S. Cl.
CPC ..... *B27D 1/08* (2013.01); *B27D 1/00* (2013.01); *B27D 3/00* (2013.01); *B27K 5/00* (2013.01);
(Continued)

(58) Field of Classification Search
None
See application file for complete search history.

(56) References Cited

U.S. PATENT DOCUMENTS 5,316,828 A * 5/1994 Miller ..... B31F 1/2863 428/182

FOREIGN PATENT DOCUMENTS

JP 48-040906 A 6/1973
JP 54-84012 A 7/1979
(Continued)

OTHER PUBLICATIONS

International Search Report and Written Opinion, International Patent Application No. PCT/JP2017/007669, dated Apr. 18, 2017, with English translation of Search Report (6 pages).

*Primary Examiner* — Barbara J Musser
(74) *Attorney, Agent, or Firm* — Hamre, Schumann, Mueller & Larson, P.C.

(57) ABSTRACT

There is provided a system 1 of manufacturing a corrugated board, including: a corrugated-shape processing apparatus 4 for processing a board in a corrugated shape by curving the board; a shaping apparatus 5 for adjusting a corrugated board acquired by processing the board in a corrugated shape; and a stabilizing apparatus 6 for stabilizing the corrugated board being shaped in the corrugated shape, the corrugated-shape processing apparatus 4 including a first pressing jig 25 and a second pressing jig 27 each of which is in a roller-like shape provided on its surface with asperities to press a board into a corrugated board, being disposed facing each other, the shaping apparatus 5 including: a third pressing jig 45 and a fourth pressing jig 48 each of which has a surface with asperities in which a distance between adjacent apexes of the asperities is substantially identical to that of a surface with asperities of the corrugated board; and a heater 59, the stabilizing apparatus 6 including a fifth
(Continued)

pressing jig 65 and a sixth pressing jig 68 each of which has a surface with asperities in which a distance between adjacent apexes of the asperities is substantially identical to that of a surface with asperities of the corrugated board after the heat-press process; and a cooling unit 69. As a result, a single board can be processed in a corrugated shape and a state of the corrugated shape can be maintained.

6 Claims, 5 Drawing Sheets

(51) Int. Cl.

| | |
|---|---|
| ***B27K 5/00*** | (2006.01) |
| ***B27M 1/00*** | (2006.01) |
| ***B31F 1/28*** | (2006.01) |
| ***B27D 1/00*** | (2006.01) |
| ***B31F 1/26*** | (2006.01) |

(52) U.S. Cl.
CPC ..... *B27M 1/00* (2013.01); *B31F 1/26* (2013.01); *B31F 1/285* (2013.01)

(56) References Cited

FOREIGN PATENT DOCUMENTS

| | | | |
|---|---|---|---|
| JP | 2011-207159 | A | 10/2011 |
| JP | 2012-214051 | A | 11/2012 |

* cited by examiner (A)

(B)

(C)

CORRUGATED BOARD MANUFACTURING SYSTEM AND CORRUGATED BOARD MANUFACTURING METHOD

TECHNICAL FIELD

The present invention relates to a system of manufacturing a corrugated board and a method for manufacturing a corrugated board, for shaping a single plate in a corrugated shape, for example.

BACKGROUND ART

Conventionally, various processing methods for wood have been proposed. As one type of processing method, the applicant has proposed a corrugated board acquired by processing a board in a corrugated shape and a method for manufacturing the corrugated board (refer to Patent Literature 1). This method is performed such that a board is fed between two heat rollers each provided in its outer periphery with asperities to be pressed and curved by the two heat rollers to acquire a corrugated board.

This method allows the applicant to succeed in acquiring a corrugated board formed in a corrugated shape.

Here, a raw material of this corrugated board is a board. Thus, it is preferable not to apply coating or the like to a surface of the board to utilize a texture and an aroma of the board. When coating or the like is not applied to a board after being processed in a corrugated shape, a flexural portion is loosened due to properties of wood to cause a force for gradually restoring the board to its original straight shape. Particularly, when a board is placed in a humid environment or when it is wetted by moisture, the force for restoring it increases to make it difficult to maintain a curvature rate at the beginning of processing.

Meanwhile, other methods each also have been proposed as a method for processing a board in a corrugated shape (refer to Patent Literatures 2 to 4). These methods each not only allow a board to be processed in a corrugated shape with a suitable jig, but also have a devised way such as using plywood, or attaching separate boards on respective sides of a board with an adhesive. When plywood in which boards are laminated in multiple layers while being bonded with an adhesive is used, or boards are attached on respective sides of a board with an adhesive, as described above, a corrugated state of a corrugated board is maintained by the adhesive. This enables the corrugated board to be prevented from returning to a board shape even in a place with high humidity or even when being wet with water.

However, this kind of method always needs a material other than wood such as adhesive to maintain a flexural state of the wood, so that there are problems that it is difficult to utilize an aroma and a texture of the board, and that a material other than natural substances (wood), such as a synthetic adhesive, needs to be used.

CITATION LIST

Patent Literature

Patent Literature 1: Japanese Unexamined Patent Publication No. 2012-214051

Patent Literature 2: Japanese Unexamined Patent Publication No. S54-84012

Patent Literature 3: Japanese Unexamined Patent Publication No. S48-040906

Patent Literature 4: Japanese Unexamined Patent Publication No. 2011-207159

SUMMARY OF THE INVENTION

Technical Problems

The present invention is made in light of the above problems, and an object thereof is to provide a system of manufacturing a corrugated board and a method for manufacturing a corrugated board, being capable of processing a single plate in a corrugated shape and maintaining a state of the corrugated shape, to improve user satisfaction.

Solution to Problems

The present invention relates to a system of manufacturing a corrugated board and a method for manufacturing a corrugated board each including: a corrugated-shape processing apparatus for processing a single board in a corrugated shape by curving the single board; a shaping apparatus for adjusting a shape of a single corrugated board acquired by processing the single board in a corrugated shape; and a stabilizing apparatus for stabilizing the single corrugated board being shaped in the corrugated shape. The corrugated-shape processing apparatus includes: a first pressing jig in a roller-like shape, having an outer peripheral surface being a contact surface to be brought into contact with one surface of the single board, the outer peripheral surface being provided with a plurality of protrusions each extending straight to be parallel to a rotation axis, the plurality of protrusions being disposed nearly parallel to each other at substantially regular intervals; and a second pressing jig in a roller-like shape, having an outer peripheral surface being a contact surface to be brought into contact with the other surface of the single board, the outer peripheral surface being provided with a plurality of protrusions each extending straight to be parallel to a rotation axis so as to face a recess between the protrusions of the first pressing jig, the plurality of protrusions being disposed nearly parallel to each other at substantially regular intervals. The shaping apparatus includes: a third pressing jig having a surface with asperities in which a distance between adjacent apexes of the asperities is substantially identical to that of one surface with asperities of the single corrugated board, apexes of a plurality of protrusions being positioned in a plane, and most receded points of a plurality of recesses being positioned in a plane; a fourth pressing jig having a surface with asperities in which a distance between adjacent apexes of the asperities is substantially identical to that of the other surface with asperities of the single corrugated board, apexes of a plurality of protrusions being positioned in a plane, and most receded points of a plurality of recesses being positioned in a plane; and heating means for heating at least one of the third pressing jig and the fourth pressing jig to a predetermined temperature. The stabilizing apparatus includes: a fifth pressing jig having a surface with asperities in which a distance between adjacent apexes of the asperities is substantially identical to that of one surface with asperities of the single corrugated board after being pressed and heated by the shaping apparatus, apexes of a plurality of protrusions being positioned in a plane, and most receded points of a plurality of recesses being positioned in a plane; a sixth pressing jig having a surface with asperities in which a distance between adjacent apexes of the asperities is substantially identical to that of the other surface with asperities of the single corrugated board after being pressed and heated by the shaping apparatus, apexes of a plurality of protrusions being positioned in a plane, and most receded points of a plurality of recesses being positioned in a plane; and cooling means for cooling at least one of the fifth pressing jig and the sixth pressing jig to a predetermined cooling temperature lower than the predetermined temperature.

Advantageous Effects of Invention

The present invention enables proving a system of manufacturing a corrugated board and a method for manufacturing a corrugated board, being capable of processing a single board in a corrugated shape and maintaining a state of the corrugated shape.

DESCRIPTION OF EMBODIMENTS

Hereinafter, an embodiment of the present invention will be described with reference to the drawings.

Embodiments

Figure 1:
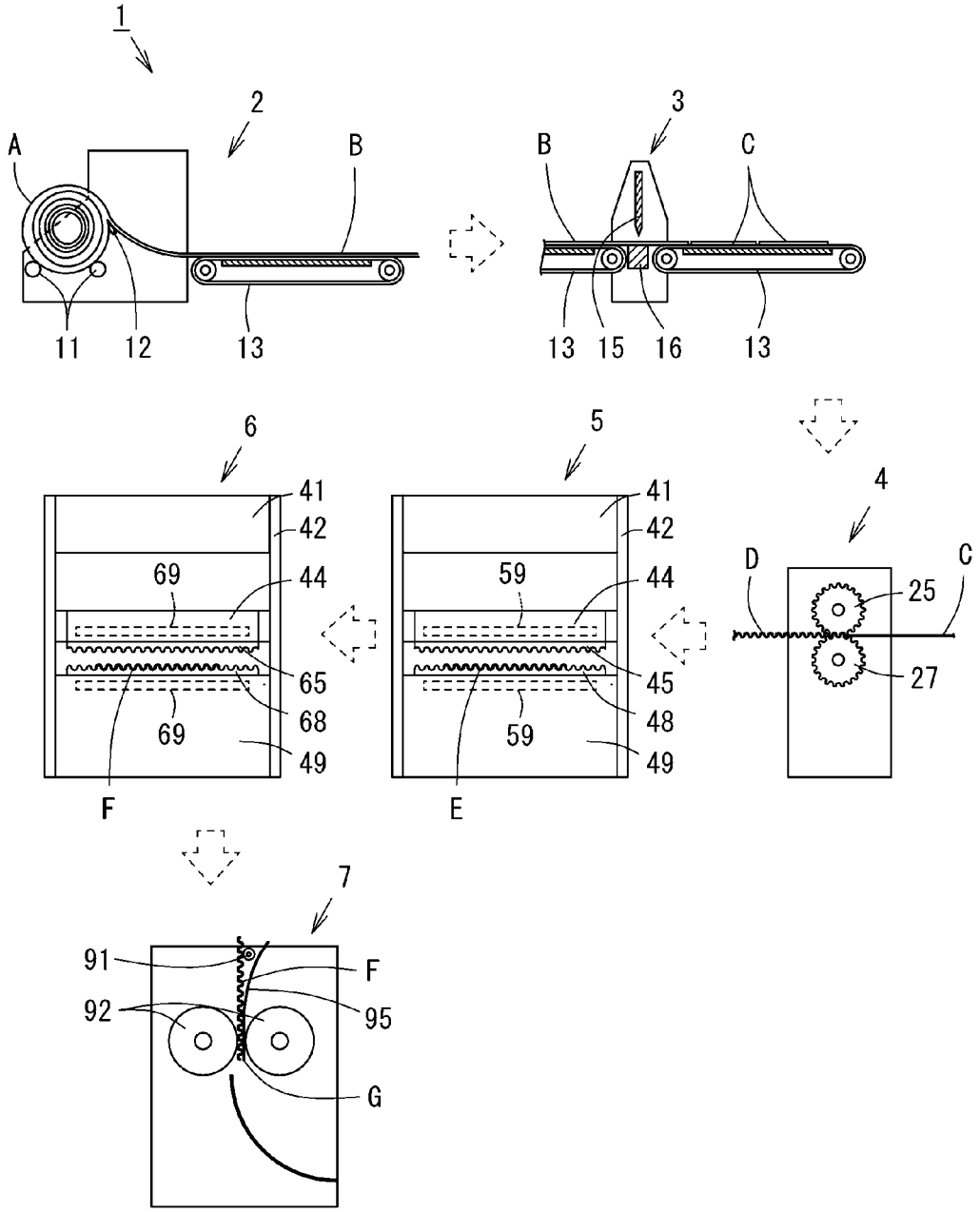
FIG. 1 is a diagram showing a general structure of a system of manufacturing a corrugated board.

FIG. 1 is a diagram showing a general structure of a system 1 of manufacturing a corrugated board.

The system 1 of manufacturing a corrugated board includes a rotary cutting apparatus 2 for forming wood into a thin board with rotary cutting, a cutting apparatus 3 for cutting the thin board acquired by the rotary cutting into a predetermined size to form a board, a corrugated-shape processing apparatus 4 for processing a board in a corrugated shape, a shaping apparatus 5 for shaping the corrugated board processed in a corrugated shape into a beautiful corrugated shape, a stabilizing apparatus 6 for stabilizing the shaped corrugated board in its shape, and a bonding apparatus 7 for bonding a corrugated board to a flat plate.

The rotary cutting apparatus 2 includes a rotation support roller 11 for rotatably placing wood A logged and dried, a blade 12 for cutting the wood A placed on the rotation support roller 11 into slices with rotary cutting, and a belt conveyor 13 for conveying a thin board B sliced with the rotary cutting. As a result, the wood A is continuously sliced in its circumferential direction with rotary cutting, so that the board B longer than the outer circumference of the wood A can be acquired. That is, the board B acquired has a width direction corresponding to the core direction of the wood A, and a longitudinal direction corresponding to the circumferential direction of the wood A.

The cutting apparatus 3 includes a cutting blade 15 that cuts the board B, a cutting table 16 disposed under the cutting blade 15 to serve as a table at the time of cutting, and a belt conveyor 13 for conveying the board B in a direction perpendicular to a cutting direction (the vertical direction in the drawings) of the cutting blade 15. This enables the board B to be cut at a desired length to acquire a plurality of boards C. Each of the boards C has a longitudinal direction corresponding to the circumferential direction of the wood A, and a width direction (lateral direction) corresponding to the core direction of the wood A.

The corrugated-shape processing apparatus 4 processes the board C containing moisture at a predetermined temperature (preferably 50° C. or more and 100° C. or less) in a corrugated shape to acquire a corrugated board D. The shaping apparatus 5 heats and presses the corrugated board D using a heater 59, a third pressing jig 45, and a fourth pressing jig 48 to acquire a corrugated board E shaped in a beautiful state without a twist and the like. The stabilizing apparatus 6 cools and presses the corrugated board E using a cooling unit 69, a fifth pressing jig 65, and a sixth pressing jig 68 to form a corrugated board F capable of maintaining a beautiful corrugated shape for a long period of time. This corrugated board F is not curved in the core direction of the wood A being the width direction (short side direction) of the board C, and is curved in the circumferential direction of the wood A being the longitudinal direction of the board C to form asperities in a corrugated shape. Details of the corrugated-shape processing apparatus 4, the shaping apparatus 5, and the stabilizing apparatus 6 will be described below.

The bonding apparatus 7 bonds a flat plate G to the corrugated board F with an adhesive. In this bonding, the bonding apparatus 7 does not apply the adhesive to the entire surface of one side of the flat plate G, and applies the adhesive only to near a central portion of each of protrusions of the corrugated board F, or only most protruding portions, to bond the corrugated board F to the flat plate G with the adhesive. Thus, portions being in contact with the flat plate G in a corrugated surface of the corrugated board F are fixed with the adhesive, and no adhesive is applied to portions being not in contact with the flat plate G in the corrugated surface, so that wood being raw material is exposed as it is. This enables the flat plate G and the corrugated board F to be bonded to each other while utilizing a merit of wood at the maximum.

The illustrated example shows that one flat plate G is bonded to one side of the corrugated board F so that one of two corrugated surfaces of the corrugated board F is completely exposed. This allows a beautiful corrugated surface of wood to be visually recognized to enable a beautiful design to be demonstrated.

Besides the illustrated example, flat plates G may be bonded to respective sides of the corrugated board F so that the corrugated surface cannot be seen. This case enables a board in the shape of a corrugated cardboard to be provided, so that the board has a weight lighter than a common board identical in thickness due to cavities provided in the corrugated board F and enables its strength to be maintained.

In addition, the flat plate G may be drilled to execute an appropriate design, and the drilled flat plate G may be bonded to the corrugated board F. This case allows a drilled portion of the flat plate G to expose the corrugated surface of the corrugated board F, so that a beautiful design can be provided.

Figure 2:
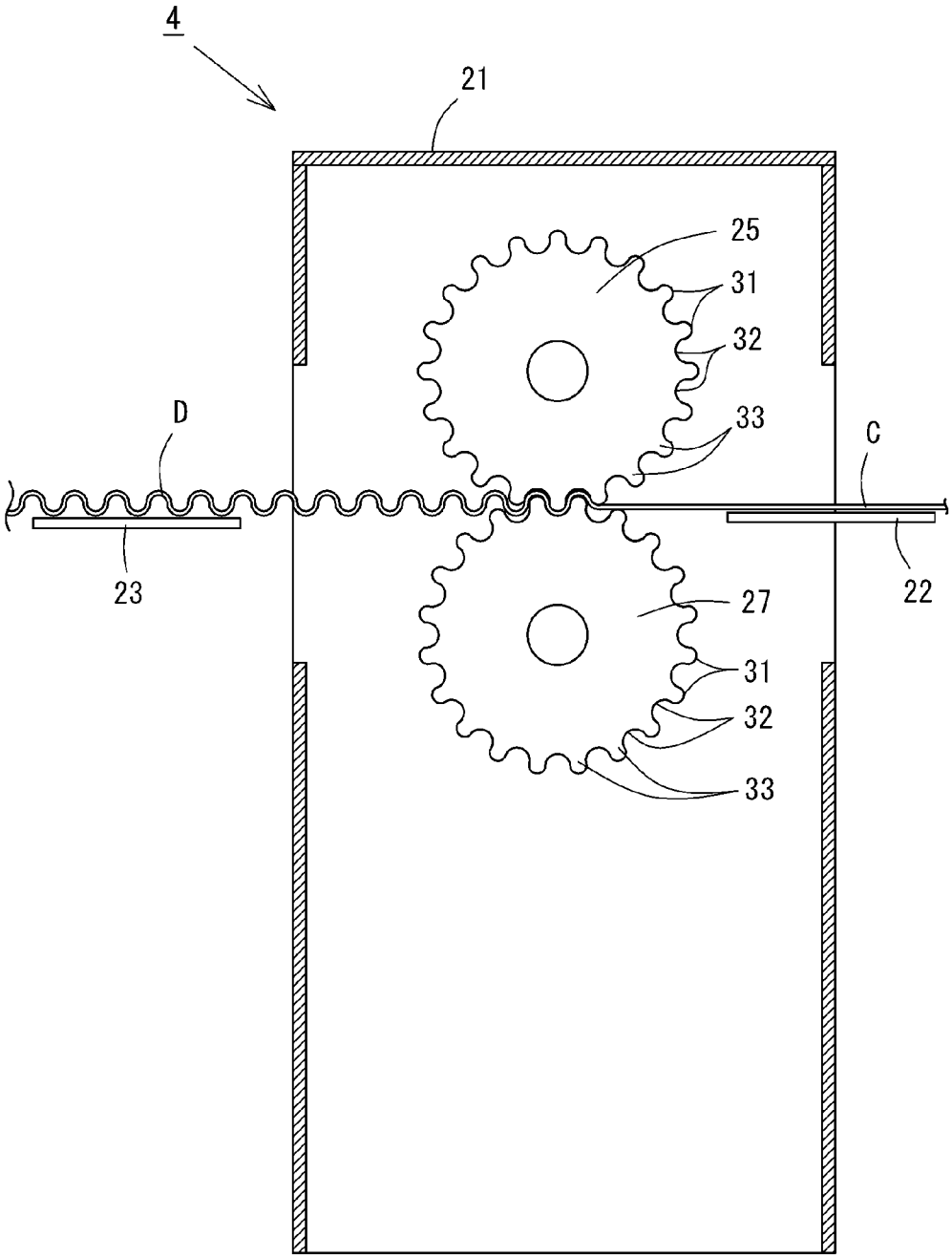
FIG. 2 is a longitudinal left side sectional view showing a structure of a corrugated-shape processing apparatus.

FIG. 2 is a longitudinal left side sectional view showing a structure of the corrugated-shape processing apparatus 4.

The corrugated-shape processing apparatus 4 has a body 21 in a rectangular parallelepiped shape. The body 21 is provided its inside with two jigs each in a roller-like shape, having an outer peripheral surface with asperities, i.e., a first pressing jig 25 and a second pressing jig 27, being disposed up and down while facing each other. The first pressing jig 25 and the second pressing jig 27 each are a roller having an axial length longer than a lateral width (a depth direction in each drawing) of the corrugated board D, and are provided with protrusions 31 extending straight, parallel to its rotation axis, being disposed at equal intervals in its circumferential direction. Between the adjacent protrusions 31, a recess 32 is formed. The corrugated-shape processing apparatus 4 is provided with heating means (heater) (not shown) for heating the first pressing jig 25 and the second pressing jig 27. The heating means heats the first pressing jig 25 and the second pressing jig 27, and also heats the board C to be processed to facilitate processing of the board C.

The first pressing jig 25 and the second pressing jig 27 are adjusted such that a clearance therebetween at the closest position is the same as or approximately the same as a thickness of the board C to be processed. The clearance and the thickness of the board C are each preferably 0.5 mm to 1.0 mm.

In front (right in each drawing) of the corrugated-shape processing apparatus 4, a transport table 22 for transporting the board C is provided. The board C is transported from the transport table 22 to a clearance between the first pressing jig 25 and the second pressing jig 27.

Behind (left in each drawing) of the corrugated-shape processing apparatus 4, a transport table 23 for transporting the corrugated board D in a corrugated shape acquired by being pressed is provided. The corrugated board D is transported onto the transport table 23 to be ejected.

When receiving supply of the board C containing moisture at a predetermined temperature (50° C. or higher and 100° C. or lower), the corrugated-shape processing apparatus 4 configured as described above heats and presses the board C between the first pressing jig 25 and the second pressing jig 27 to form it in a corrugated shape, and then ejects the corrugated board D.

Figure 3:
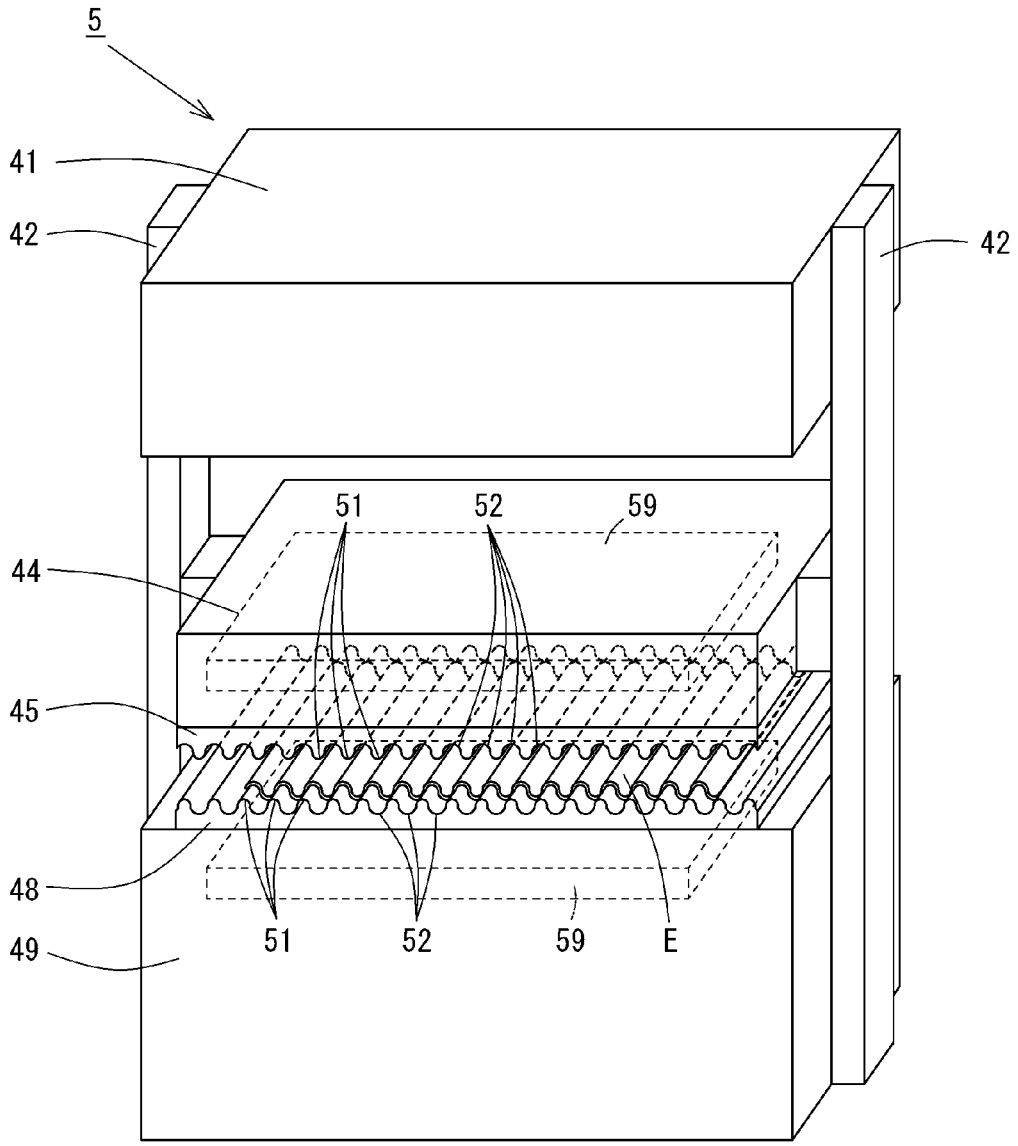
FIG. 3 is a perspective view showing a structure of a shaping apparatus.

FIG. 3 is a perspective view showing a structure of the shaping apparatus 5.

The shaping apparatus 5 includes a rectangular base 49, guide arms 42 and 42 provided on the left and right sides of the base 49, respectively, while extending straight in a vertical direction, a ceiling portion 41 provided inside upper portions of the respective guide arms 42 and 42, and a slide 44 that slidably moves vertically along the guide arms 42 and 42, between the ceiling portion 41 and the base 49.

The slide 44 is provided in its bottom surface with the third pressing jig 45 disposed substantially horizontally. The third pressing jig 45 has a corrugated pressing surface in which protrusions 51 and recesses 52 are alternately disposed on the bottom surface. This pressing surface is formed in a shape in which the plurality of protrusions 51 and the plurality of recesses 52, extending straight in the depth direction, are each disposed parallel to each other in the same plane at the same height and at equal intervals.

The base 49 is provided on its top surface with the fourth pressing jig 48 disposed substantially horizontally. The fourth pressing jig 48 has a corrugated pressing surface in which protrusions 51 and recesses 52 are alternately disposed on the bottom surface. This pressing surface is formed in a shape in which the plurality of protrusions 51 and the plurality of recesses 52, extending straight in the depth direction, are each disposed parallel to each other in the same plane at the same height and at equal intervals. The protrusion 51 of the fourth pressing jig 48 faces the recess 52 of the third pressing jig 45, and the recess 52 of the fourth pressing jig 48 faces the protrusion 51 of the third pressing jig 45. As a result, when the third pressing jig 45 descends together with the slide 44, a thin corrugated space is formed between the third pressing jig 45 and the fourth pressing jig 48. This enables the corrugated board E sandwiched between the third pressing jig 45 and the fourth pressing jig 48 in the space to be shaped in a corrugated shape without distortion.

Each of the slide 44 and the base 49 has a heater 59 (heating means) built-in for heating the corresponding one of the third pressing jig 45 and the fourth pressing jig 48. Accordingly, the third pressing jig 45 and the fourth pressing jig 48 can be heated to a desired temperature (e.g., a temperature of 110° C. or more and not being carbonized).

As shown in FIG. 1, the stabilizing apparatus 6 includes the same ceiling portion 41, guide arms 42, slide 44 and base 49 as those of the shaping apparatus 5, and includes a cooling unit 69 (cooling means) instead of the heater 59. The cooling unit 69 can cool the fifth pressing jig 65 and the sixth pressing jig 68 to a desired temperature (e.g., 25° C. or lower). The stabilizing apparatus 6 also includes the fifth pressing jig 65 and the sixth pressing jig 68 instead of the third pressing jig 45 and the fourth pressing jig 48. The structure other than the fifth pressing jig 65, the sixth pressing jig 68, and the cooling unit 69 is the same as that of the shaping apparatus 5 shown in FIG. 3, so that detailed description thereof is omitted.

Figure 4:
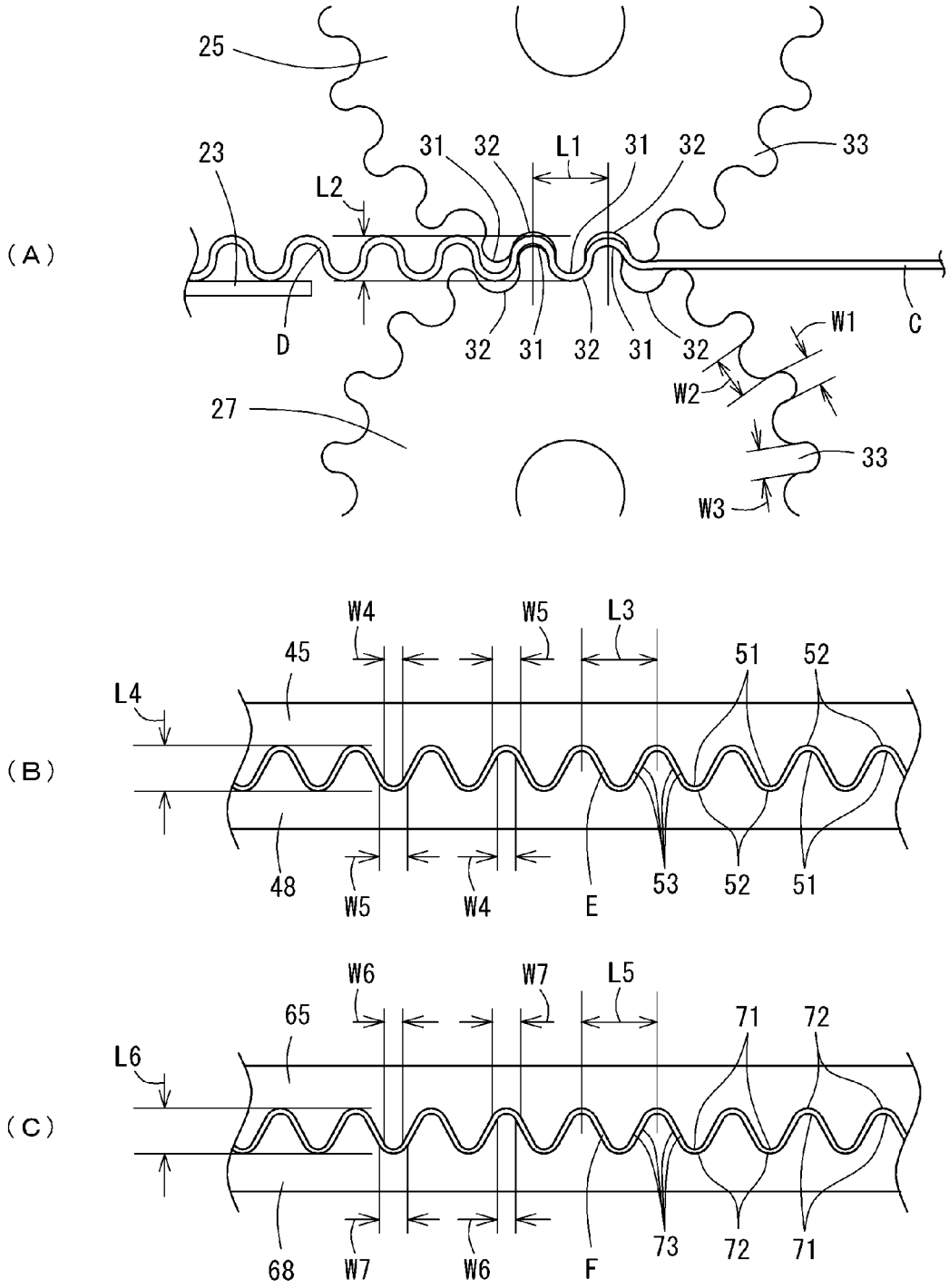
FIG. 4 is an illustration showing a detailed structure of each pressing jig.

FIG. 4 is an illustration showing a detailed structure of each pressing jig.

FIG. 4(A) is a partially enlarged right side view illustrating a detailed structure of the first pressing jig 25 and the second pressing jig 27.

The first pressing jig 25 and the second pressing jig 27 are heated by an appropriate heating device. This causes the board C to be heated to facilitate a curving process of the board C.

The first pressing jig 25 and the second pressing jig 27 are identical in size, shape and material, and are disposed such that their outer peripheral surfaces face each other at portions close to each other.

Each of the protrusions 31 of the first pressing jig 25 and the second pressing jig 27, most protruding therein, is formed to be slightly smaller than each of the recesses 32 of the first pressing jig 25 and the second pressing jig 27. A difference in size between the protrusion 31 and the recess 32 is formed such that a difference between the radius of the protrusion 31 and the radius of the recess 32 is substantially the same as a thickness (0.5 mm to 1.0 mm) of the board C to be processed in a corrugated shape. In other words, a diameter W1 of the protrusion 31 and a diameter W2 of the recess 32 are provided to be different from each other by approximately twice of a thickness (0.5 mm to 1.0 mm) of the board C. This causes a clearance between the protrusion 31 and recess 32 in a semicircular portion in which the protrusion 31 and recess 32 face each other while being close to each other to be substantially identical to a thickness (0.5 mm to 1.0 mm) of the board C.

In addition, the protrusion 31 and the recess 32 are each formed in an area similar to or more than a substantially semicircle, and the protrusion 31 positioned between the two recesses 32 is provided with a constricted portion 33 tapering toward its base portion or having a shape similar thereto. That is, the protrusion 31 is formed such that the base portion has a width W3 less than the diameter W1 being the maximum width of the protrusion 31. Accordingly, the board C can be curved slightly larger than a desired corrugated shape.

When the board C is sandwiched and pressed between the protrusion 31 and the recess 32, formed as described above, the board C can be curved satisfactorily. The protrusion 31 and the recess 32 are alternately provided along the outer periphery of each of the first pressing jig 25 and the second pressing jig 27, so that the board C is formed into the corrugated board D in which asperities are repeated to form a corrugated shape by pressing and transporting the board C while the first pressing jig 25 and the second pressing jig 27 are rotated. In addition, due to the constricted portion 33, the protrusion 31 and the recess 32 are not brought into close contact with the entire surface of the corrugated board D, and an apex portion of the corrugated shape in the corrugated board D is pressed while a portion in the board C being a flat plate is naturally deformed, so that the board C can be continuously deformed into the corrugated shape without trouble. That is, even when the board C is curved and deformed to alternately form the protrusion and the recess, the board C can be prevented from being broken such as being cracked to enable favorable and stable processing.

The corrugated board D is formed such that a distance L1 between asperities is substantially identical to a distance between apexes of the respective adjacent protrusions 31. In addition, a thickness L2 (corresponding to an amplitude of the corrugated shape) of a portion of the asperities of the corrugated board D is substantially identical to a distance between a position at which the most recessed portion of the recess 32 of the first pressing jig 25 becomes the lowermost position, and a position at which the most recessed portion of the recess 32 of the second pressing jig 27 becomes the uppermost position. The thickness L2 is less than the distance L1, and is approximately half or less than half of the distance L1.

FIG. 4(B) is a partially enlarged front view showing a detailed structure of the third pressing jig 45 and the fourth pressing jig 48.

The third pressing jig 45 and the fourth pressing jig 48 are disposed facing each other so that their asperities are fitted with each other, and each include the protrusions 51 and the recesses 52 that are alternately disposed. The third pressing jig 45 and the fourth pressing jig 48 are each formed such that all of the protrusions 51 are uniform in height and are disposed parallel to each other at equal intervals in the depth direction in FIG. 4, and such that apexes of the respective protrusions 51 are positioned in a plane. In addition, the third pressing jig 45 and the fourth pressing jig 48 are each formed such that all of the recesses 52 are uniform in depth and are disposed parallel to each other at equal intervals in the depth direction in FIG. 4, and such that most recessed portions of the respective recesses 52 are positioned in a plane.

The protrusions 51 are formed such that a distance L3 between apexes (most recessed portions of the recess 52) of the respective adjacent protrusions 51 is identical to the distance L1 of the corrugated board D described with reference to FIG. 4(A). As a result, when the corrugated board D is placed on the fourth pressing jig 48 and the third pressing jig 45 is lowered to press the corrugated board D from above, the corrugated board D can be disposed easily and accurately such that the corrugated shape of the corrugated board D matches the corrugated shape of each of the third pressing jig 45 and the fourth pressing jig 48. This enables the corrugated board D to be prevented from being broken due to displacement of the corrugated shape of each of the third pressing jig 45 and the fourth pressing jig 48 when the corrugated board D is pressed by the third pressing jig 45 and the fourth pressing jig 48.

The protrusion 51 of third pressing jig 45 and the protrusion 51 of the fourth pressing jig 48 are formed such that a thickness L4 (height of the corrugated shape of the corrugated board) being a difference between their heights is identical or substantially identical to the thickness L2 (refer to FIG. 4(A)) of the corrugated board D. Accordingly, the corrugated board D can be pressed nearly uniformly without applying an excessive force to the corrugated board D, so that the corrugated board D can be satisfactorily shaped to acquire the corrugated board E.

The protrusion 51 and the recess 52 are formed such that a width W4 of an arcuate portion of the protrusion 51 is less than a width W5 of an arcuate portion of the recess 52, and such that a clearance between the protrusion 51 and the recess 52 is identical or substantially identical to a thickness of the corrugated board D. That is, the protrusion 51 and the recess 52 are formed such that a difference between a radius of the arcuate portion of the protrusion 51 and a radius of the arcuate portion of the recess 52 is identical or substantially identical to the thickness of the corrugated board D. In addition, an inclined portion 53 of each of the protrusion 51 and the recess 52, positioned threrebetween, is formed such that a clearance between facing surfaces of the third pressing jig 45 and the fourth pressing jig 48 is identical or substantially identical to the thickness of the corrugated board D.

The inclined portion 53 is not constricted as between the protrusion 31 and the recess 32 of the first pressing jig 25 and the second pressing jig 27 shown in FIG. 4 (A) (or without the constricted portion), and is formed so as to gradually incline from the protrusion 51 to the recess 52. The inclined portion 53 is formed in a linear shape or in a gentle S-shape close to a straight line. The inclined portion 53 causes the protrusion 51 to have a base portion without being constricted and to be formed so as to gradually taper from the base portion to its tip.

The structure described above enables the third pressing jig 45 and the fourth pressing jig 48 to evenly press the corrugated board D while heating the entire front and back surfaces thereof to a desired temperature (a temperature of 100° C. or higher at which an object to be pressed does not carbonize) to shape the corrugated board D into the corrugated board E (refer to FIG. 1). The third pressing jig 45 and the fourth pressing jig 48 heated by the heater 59 (refer to FIG. 3) press the corrugated board D, so that the corrugated board D can be firmly pressed to be shaped into the corrugated board E (refer to FIG. 1) in a beautiful corrugated shape without a twist.

FIG. 4(C) is a partially enlarged front view showing a detailed structure of the fifth pressing jig 65 and the sixth pressing jig 68 of the stabilizing apparatus 6 (refer to FIG. 1).

The fifth pressing jig 65 and the sixth pressing jig 68 are disposed facing each other so that their asperities are fitted with each other, and each include the protrusions 71 and the recesses 72 that are alternately disposed. The protrusion 71 and the recess 72 are identical to the protrusion 51 and the recess 52 of the third pressing jig 45 and the fourth pressing jig 48, respectively, in placement, size, and shape. In addition, a distance L5, a width W6, and a width W7 are also identical to the distance L3, the width W4, and the width W5 shown in FIG. 4(B). Further, a thickness L6 (height of a corrugated shape of a corrugated board) is also identical or substantially identical to the thickness L4. Besides, the third pressing jig 45 and the fourth pressing jig 48 are identical to the fifth pressing jig 65 and the sixth pressing jig 68, respectively, in shape, so that detailed description thereof is omitted.

The structure described above enables the fifth pressing jig 65 and the sixth pressing jig 68 to evenly press the corrugated board E while cooling the entire front and back surfaces thereof to a desired temperature (25° C. or less), so that the corrugated board E can be stabilized as the corrugated board F. When the fifth pressing jig 65 and the sixth pressing jig 68, cooled by the cooling unit 69, press the corrugated board E, the corrugated board E is promptly cooled, which enables the corrugated board E to be stabilized in shape to form the corrugated board F. As a result, the corrugated board F can be prevented from changing in shape, such as losing shape naturally or lowering asperities due to elongation. In particular, while the corrugated board F is a single plate to which no adhesive or the like is applied unlike plywood, the corrugated board F can be stably maintained in corrugated shape.

Figure 5:
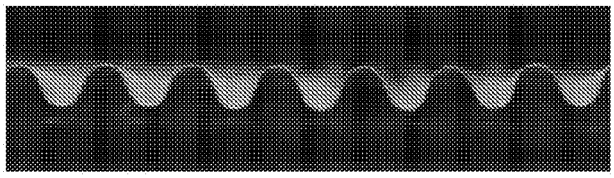
FIG. 5 is a photograph showing a completed corrugated board.
Figure 5:
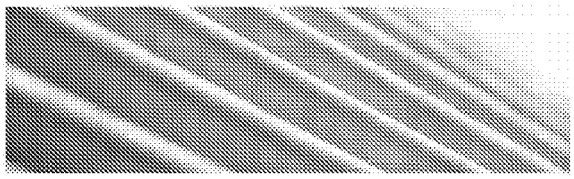
Figure 5:
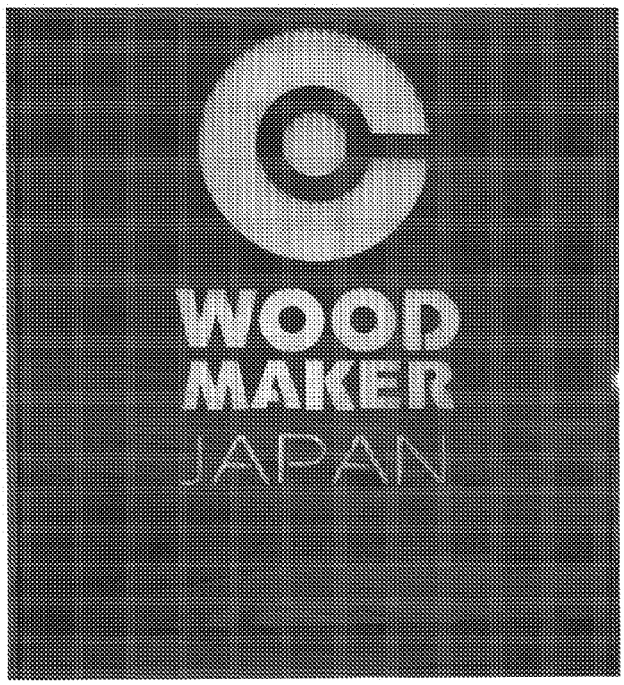

According to the system 1 of manufacturing a corrugated board as described above, the beautiful corrugated board F in which a flat plate is corrugated by equal widths in one direction can be acquired, as shown in a photograph in the front view of FIG. 5(A). As shown in the photograph in the perspective view of FIG. 5(B), the corrugated board F shows that natural grain of wood appears on a surface, and that corrugated protrusions and recesses, disposed parallel to each other at equal intervals, weave a beautiful design. The beautiful corrugated board F can be used so as to be formed into various products. For example, as shown in FIG. 5(C), a part of the board is cut out into a shape of a letter or a figure, and is stacked and pasted on the corrugated board F to enable forming of a signboard in which a corrugated shape of grain of wood can be seen through the cutout portion.

The corrugated board F thus acquired is stable in shape by itself without performing surface coating or bonding to other members. Accordingly, the corrugated board F can be prevented from returning to its original shape of a plate due to moisture or the like. Thus, even when a flat plate is stacked and bonded to one side or each side of the corrugated board F, the corrugated board F can be prevented from being deformed or broken due to stress applied when being tried to return to the shape of a flat plate.

In addition, the corrugated board F thus acquired has a stable shape without a twist, so that it can be not only placed on a flat surface without rattling, but also easily bonded to a flat plate. This causes the corrugated board F not to be curved in the lateral direction in which the asperities linearly extend, and to be freely curved in the longitudinal direction in which corrugation of the corrugated shape develops.

The present invention is not limited to the present embodiment, and may achieve various other embodiments.

For example, the bonding apparatus 7 may be eliminated, and the corrugated board F formed in a corrugated shape may be directly used. This case can be applied to a product utilizing a design of a corrugated shape, and when it is desired to use a wooden material in the shape of a corrugated cardboard, the corrugated board F can be used by appropriately bonding a flat plate to the corrugated board F separately.

In addition, the corrugated board D may be impregnated with resin to perform shaping by heat-press with the shaping apparatus 5 and stabilization by cool-press with the stabilizing apparatus 6. Alternatively, the corrugated board E may be impregnated with resin to perform stabilization by cool-press with the stabilizing apparatus 6. In this case, the impregnation of the finished corrugated board F with the resin enables prevention of deformation of the corrugated board F due to trying to return to the shape of a flat plate for a long period of time.

INDUSTRIAL APPLICABILITY

The present invention is applicable to industries that process wood and industries that use processed wood.

REFERENCE SIGNS LIST

1: system of manufacturing a corrugated board
4: corrugated-shape processing apparatus
5: shaping apparatus
6: stabilizing apparatus
25: first pressing jig
27: second pressing jig
31: protrusion
32: recess
33: constricted portion
45: third pressing jig
48: fourth pressing jig
53: inclined portion
59: heater
65: fifth pressing jig
68: sixth pressing jig
69: cooling unit
C: board
D, E, F: corrugated board
L1, L3, L5: distance
L4, L6: thickness

The invention claimed is:

1. A system of manufacturing a corrugated board, comprising:

a corrugated-shape processing apparatus for processing a single board in a corrugated shape by curving the single board;

a shaping apparatus for adjusting a shape of a single corrugated board acquired by processing the single board in a corrugated shape; and a stabilizing apparatus for stabilizing the single corrugated board being shaped in the corrugated shape, the corrugated-shape processing apparatus including:

a first pressing jig in a roller shape, having an outer peripheral surface being a contact surface to be brought into contact with one surface of the single board, the outer peripheral surface being provided with a plurality of protrusions each extending straight to be parallel to a rotation axis, the plurality of protrusions being disposed nearly parallel to each other at substantially regular intervals; and a second pressing jig in a roller shape, having an outer peripheral surface being a contact surface to be brought into contact with the another surface of the single board, the outer peripheral surface being provided with a plurality of protrusions each extending straight to be parallel to a rotation axis so as to face a recess between the protrusions of the first pressing jig, the plurality of protrusions being disposed nearly parallel to each other at substantially regular intervals, the shaping apparatus including:

a third pressing jig having a surface with asperities in which a distance between adjacent apexes of the asperities is substantially identical to that of one surface with asperities of the single corrugated board, apexes of a plurality of protrusions being positioned in a plane, and most receded points of a plurality of recesses being positioned in a plane;

a fourth pressing jig having a surface with asperities in which a distance between adjacent apexes of the asperities is substantially identical to that of another surface with asperities of the single corrugated board, apexes of a plurality of protrusions being positioned in a plane, and most receded points of a plurality of recesses being positioned in a plane; and heating means for heating at least one of the third pressing jig and the fourth pressing jig to a predetermined temperature, the stabilizing apparatus including:

a fifth pressing jig having a surface with asperities in which a distance between adjacent apexes of the asperities is substantially identical to that of one surface with asperities of the single corrugated board after being pressed and heated by the shaping apparatus, apexes of a plurality of protrusions being positioned in a plane, and most receded points of a plurality of recesses being positioned in a plane;

a sixth pressing jig having a surface with asperities in which a distance between adjacent apexes of the asperities is substantially identical to that of another surface with asperities of the single corrugated board after being pressed and heated by the shaping apparatus, apexes of a plurality of protrusions being positioned in a plane, and most receded points of a plurality of recesses being positioned in a plane; and cooling means for cooling at least one of the fifth pressing jig and the sixth pressing jig to a predetermined cooling temperature lower than the predetermined temperature.

2. The system of manufacturing a corrugated board according to claim 1, wherein the first pressing jig and the second pressing jig are adjusted such that a clearance between the first pressing jig and the second pressing jig at respective positions closest to each other is substantially identical to a thickness of the single board to be processed, the third pressing jig and the fourth pressing jig are formed such that a difference between a radius of an arcuate portion of the protrusion and a radius of an arcuate portion of the recess is substantially identical to a thickness of the single corrugated board, and an inclined portion positioned between the protrusion and the recess is formed such that a clearance between facing surfaces of the protrusion and the recess is substantially identical to the thickness of the single corrugated board, and the fifth pressing jig and the sixth pressing jig are identical in shape to the third pressing jig and the fourth pressing jig, respectively.

3. The system of manufacturing a corrugated board according to claim 2, wherein the protrusion of each of the first pressing jig and the second pressing jig includes a constricted portion with a width less than a maximum width of the protrusion, provided on a base portion side with respect to a tip of the protrusion as viewed from the recesses across the protrusion, and the third pressing jig to the sixth pressing jig each include a substantially straight portion having a curvature closer to a straight line than curvatures of an apex and a bottom of each of the asperities or being a linear shape in a connection portion between the recess and the protrusion in the surface with asperities, the protrusion being formed in a shape tapering from the base portion to the tip without a constricted portion.

4. The system of manufacturing a corrugated board according to claim 1, wherein the protrusion of each of the first pressing jig and the second pressing jig includes a constricted portion with a width less than a maximum width of the protrusion, provided on a base portion side with respect to a tip of the protrusion as viewed from the recesses across the protrusion, and the third pressing jig to the sixth pressing jig each include a substantially straight portion having a curvature closer to a straight line than curvatures of an apex and a bottom of each of the asperities or being a linear shape in a connection portion between the recess and the protrusion in the surface with asperities, the protrusion being formed in a shape tapering from the base portion to the tip without a constricted portion.

5. A method for manufacturing a corrugated board, using the system of manufacturing a corrugated board according to claim 1, the method comprising:

pressing a single board with the first pressing jig and the second pressing jig of the corrugated-shape processing apparatus to acquire a single corrugated board;

pressing the single corrugated board with the third pressing jig and the fourth pressing jig while heating the single corrugated board with the heating means for heating at least one of the third pressing jig and the fourth pressing jig of the shaping apparatus to the predetermined temperature; and pressing the single corrugated board with the fifth pressing jig and the sixth pressing jig while cooling at least one of the fifth pressing jig and the sixth pressing jig of the stabilizing apparatus to the predetermined cooling temperature lower than the predetermined temperature with the cooling means to promptly cool the single corrugated board.

6. The method for manufacturing a corrugated board according to claim 5, wherein a stabilizing process using the stabilizing apparatus is performed within thirty seconds after a shaping process using the shaping apparatus is completed.

* * * * *